United States Patent [19]

Balogh

[11] 4,071,749

[45] Jan. 31, 1978

[54] SELF-CONTAINED MAINTENANCE-FREE EMERGENCY LIGHTING

[75] Inventor: Andre Balogh, Tarrytown, N.Y.

[73] Assignee: Tork, Inc., Mount Vernon, N.Y.

[21] Appl. No.: 707,861

[22] Filed: July 22, 1976

[51] Int. Cl.[2] ..... F21V 19/04; H05B 37/00

[52] U.S. Cl. ..... 362/20; 315/86; 174/52 R; 307/66; 340/214

[58] Field of Search ..... 240/10.66, 10.6 CH, 240/11.3, 73, 37.1, 78 H, 78 R; 307/66; 85/45; 200/61.11, 61.41, 84 C; 315/86; 174/52 R; 340/214, 248 R, 410; 324/28 RS, 34 RS

[56] References Cited

U.S. PATENT DOCUMENTS

| | | | |
|---|---|---|---|
| 3,159,755 | 12/1964 | Duncan | 315/86 X |
| 3,219,811 | 11/1965 | Young | 240/10.66 |
| 3,315,074 | 4/1967 | Buzan et al. | 240/78 R |
| 3,668,418 | 6/1972 | Godard | 307/66 |
| 3,673,912 | 7/1972 | Herr | 85/45 |
| 3,833,817 | 9/1974 | Patel | 307/66 |
| 3,860,829 | 1/1975 | Fabbri | 240/37.1 X |
| 3,925,772 | 12/1975 | Miller et al. | 307/66 X |
| 3,939,359 | 2/1976 | Nehushtan et al. | 307/66 |

*Primary Examiner*—L. T. Hix
*Assistant Examiner*—William B. Perkey
*Attorney, Agent, or Firm*—John F. Ohlandt

[57] ABSTRACT

A self-contained maintenance-free emergency lighting system involving a housing including a tough plastic cover so as to protect the system from vandalism; in order to test the system to determine whether it is operating properly, i.e., such that the emergency battery supply will furnish power to the emergency lamp, a magnetically operated test switch is included within the housing. By such feature, no external projection of a switch or the like is required. An arrangement is also provided for allowing the emergency lamp or bulb to float; that is to say, to preclude any kind of shock to the dome or cover from causing breakage of such lamp. Also, the plastic dome is extremely difficult to remove in that a tamper-proof screw is provided which is not readily visible nor is it readily accessible. An electrical circuit arrangement is also provided which includes a transfer relay which is normally open.

7 Claims, 8 Drawing Figures

FIG. 4
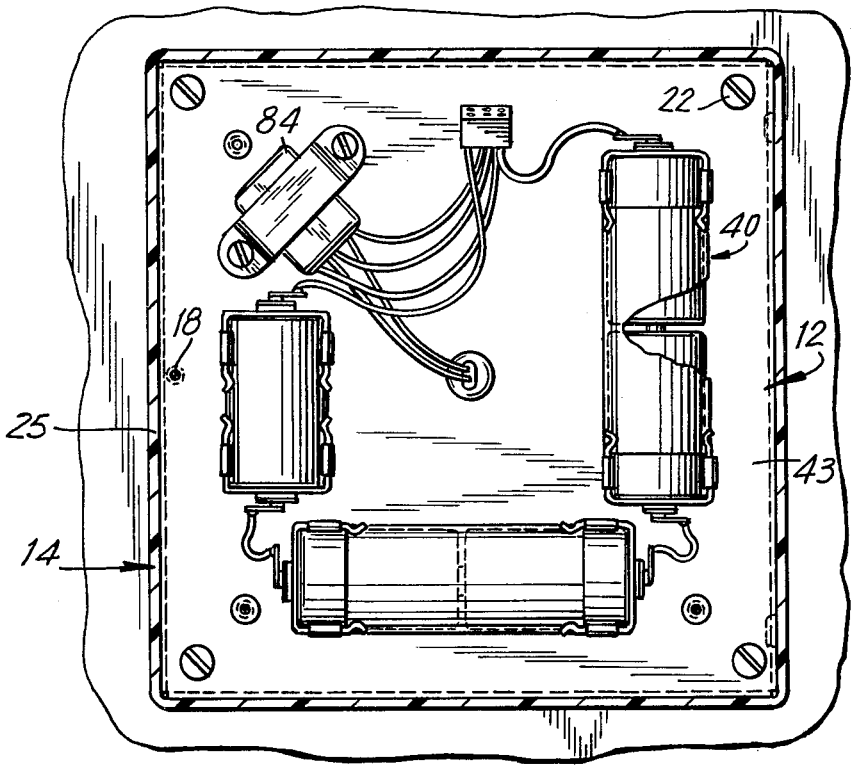
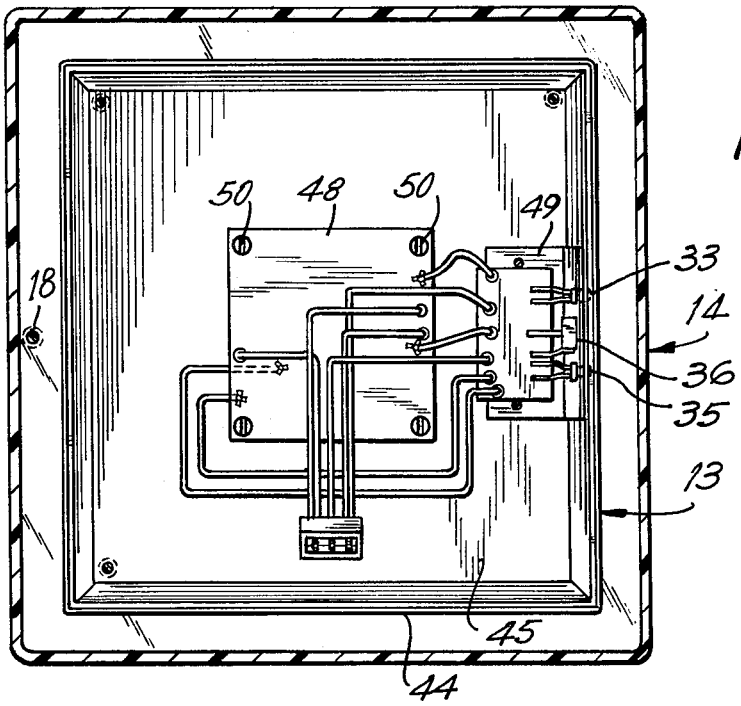
FIG. 5

SELF-CONTAINED MAINTENANCE-FREE EMERGENCY LIGHTING

BACKGROUND, OBJECTS AND SUMMARY OF THE INVENTION

The present invention pertains to an emergency lighting system that is battery operated and particularly one which is completely self-contained and is maintenance-free.

A variety of emergency lighting systems have been known in the prior art and fundamentally these systems insure that if a source of AC power which provides the normal or regular lighting for a given environment should for any reason fail, emergency lighting is furnished. Generally what this involves is an automatic switching over from the normal or regular AC supply to an encased battery supply which furnishes the needed current to an emergency lamp.

The difficulty with the design and construction of most prior art emergency lighting systems is that they do not lend themselves to the prevention of vandalism. Thus, when the emergency systems of the prior art are left unattended, they can become easily disabled by reason of tampering with switches or other mechanisms or because of breakage of important elements such as the cover of the lighting unit. As a result, such emergency lighting systems must be frequently checked to determine if any tampering has occurred.

Accordingly, it is a primary object of the present invention to provide an emergency lighting system or device that is completely self-contained so as to preclude any substantial interference with the availability of the lighting system when called for.

It is another object of the present invention to provide for a simple, inexpensive effective means for testing of the system to determine that it is operating correctly and that the emergency lamp will be energized if the AC power should be cut off.

A further object is to accomplish the testing from the outside of the emergency lighting unit while the actual test switch is fully protected.

In accordance with the objects noted above, a primary feature of the present invention resides in the provision of a magnetically operated test switch suitably connected in the electrical circuitry and located inside the housing of the emergency lighting device. All that is required is that the operator bring a suitably configured magnet close to the cover of the unit or device and to thereby cause appropriate operation of contacts within the housing so as to effectively open the AC power supply and thereby to switch in the battery supply which furnishes current to the emergency lamp.

Another primary feature of the present invention is concerned with the protection of the emergency lamp from any kind of repeated shocks to the cover or housing. To this end it is provided that the lamp floats within the housing and this is achieved by having flexible mounting of the reflector platform to which the circuitry is affixed, and also flexible connection of the printed circuit board holding the circuitry to the reflector platform.

Yet another feature of the present invention resides in a special arrangement of the cover and of a tamper-proof screw used to attach the cover to the base plate of the emergency lighting device or unit. The cover is provided with a skirt portion that encloses the perimeter of the base plate, the latter being directly mounted to a wall or ceiling. The skirt portion prevents access to the mounting screws that are used to effect the mounting or attachment of the base plate. The tamper-proof screw holds the cover in engagement with the base plate but such screw can only be loosened by having the appropriate tool.

A further feature of the invention concerns an advancement over prior art emergency lighting units which include a normally closed relay, that is, a relay whose contacts are closed when the associated coil is de-energized. Thus, when AC power is on, the relay contacts are open but such contacts close and connect the light source to the battery supply when the AC power fails. Unlike these prior art units, the emergency lighting device of the present invention utilizes a normally open relay, that is, one which is energized only during AC power failure. Thus the relay is not operative, is not consuming energy and is not therefore losing life during extended periods of AC operation.

Other and further objects, advantages and features of the present invention will be understood by reference to the following specification in conjunction with the annexed drawing, wherein like parts have been given like numbers.

BRIEF DESCRIPTION OF THE DRAWING

FIG. 4 is a sectional view, taken on line 4—4 of FIG. 3, and particularly illustrating the disposition of the battery supply;

FIG. 5 is a sectional view, taken on line 5—5, looking into the interior of the reflector of the device and particularly illustrating the lamp indicator and switch assembly of the emergency lighting device;

DESCRIPTION OF THE PREFERRED EMBODIMENT

Figure 3:
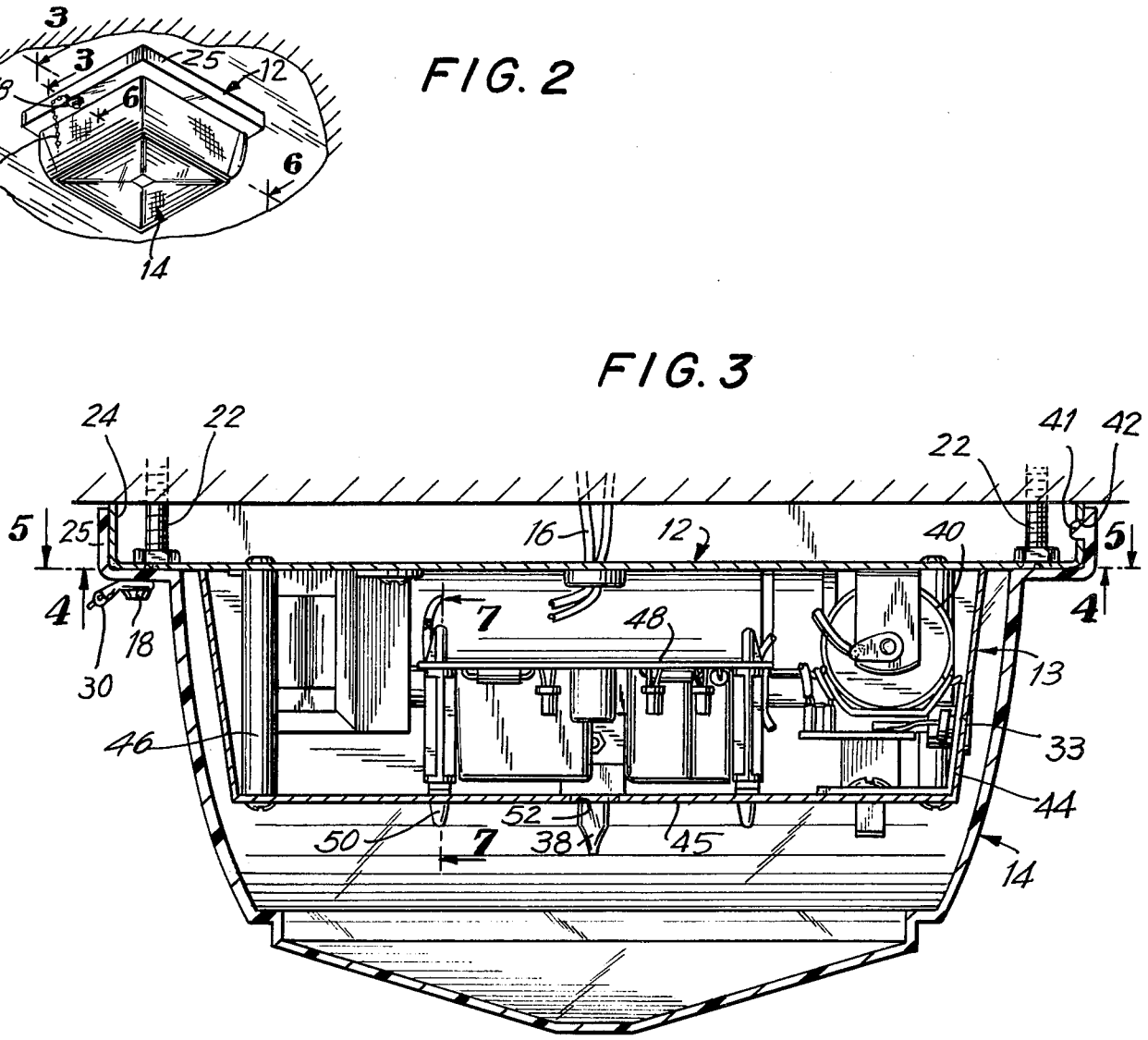
FIG. 3 is a sectional view, taken on line 3—3 of FIG. 2, showing internal parts and particularly illustrating the housing including cover, reflector, and base plate.
Figure 2:
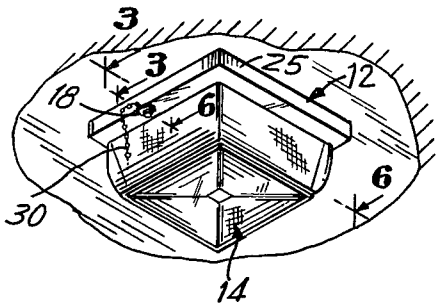
FIG. 2 is a perspective view of the emergency device shown mounted to a wall.
Figure 1:
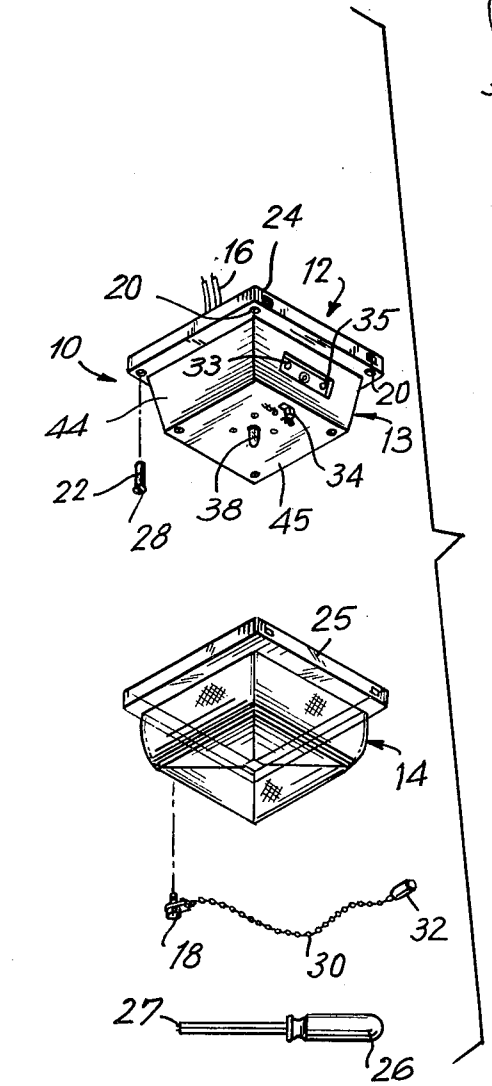
FIG. 1 is an exploded view of the emergency lighting device of the present invention, particularly illustrating the mounting and securing of such device.
Figure 7:
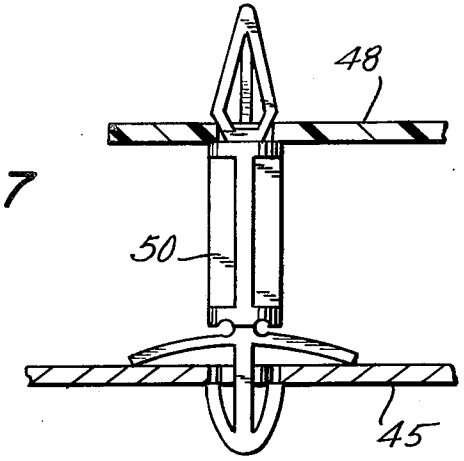
FIG. 7 is a fragmentary sectional view, taken on line 7—7 of FIG. 3, and illustrating the flexible mounting means of the reflector.
Figure 6:
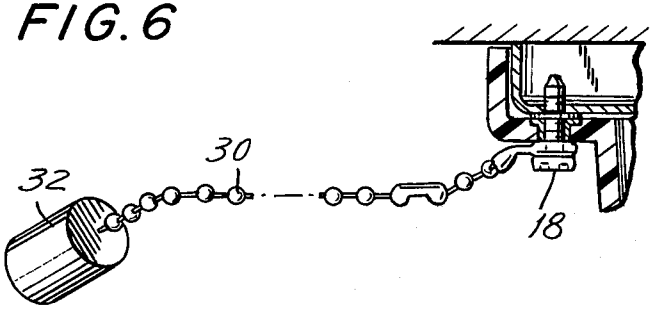
FIG. 6 is a fragmentary sectional view, taken on line 6—6 of FIG. 2, and illustrating the tamper-proof screw feature.

Referring now to the drawings, and in particular for the moment to FIG. 1, there is seen in that figure an emergency lighting device 10 comprising a base plate 12, a reflector 13, and a cover 14. A pair of AC leads or conductors 16 are typically connected to a suitable junction box, not shown. The base plate 12 is mounted to a wall or ceiling surface in correspondence or coincidence with the counter-sunk mounting holes 20 in the corners of the base plate 12, the cover 14 having been removed by loosening a non-removable vandal-proof screw 18 (FIG. 6). Attachment or affixing of the base plate to the surface is accomplished by using conventional screws 22.

In the event that the lighting device is to be used on the outside of a building where it will be exposed to weather, an optional gasket, not seen, is disposed at the rim of the skirt portion 24 of base plate 12 where that rim would normally abut with a wall or ceiling surface.

The cover 14 which is in a dome-like shape, is composed of a virtually indestructable polycarbonate plastic (Lexan) and molded in a prismatic pattern on exterior and interior, thereby to serve efficiently as a diffuser for the light source or lamp used in the system. The cover 14 includes a corresponding skirt portion 25 which completely surrounds the perimeter of the skirt portion 24 of base plate 12. The tamper-proof screw 18 is adapted to be loosened by means of a special screwdriver 26 having two points or prongs 27 which fit precisely the openings 28 in the head of the screws 22. Attached for convenience to the upper part of the screw 18 is a chain 30 to which is secured a magnet 32 for purposes to be described. By this means the magnet can be kept so as to be readily accessible when required.

It will be understood that the cover 14 which protects the entire unit, including the pilot or indicator lamps to be described, in serving as a diffuser for the emergency light source very effectively distributes the emergency light as required. It should also be noted that this cover/diffuser will withstand repeated blows by a blunt instrument as high as 35 foot-lbs. and will withstand temperatures up to 290° F.

Figure 8:
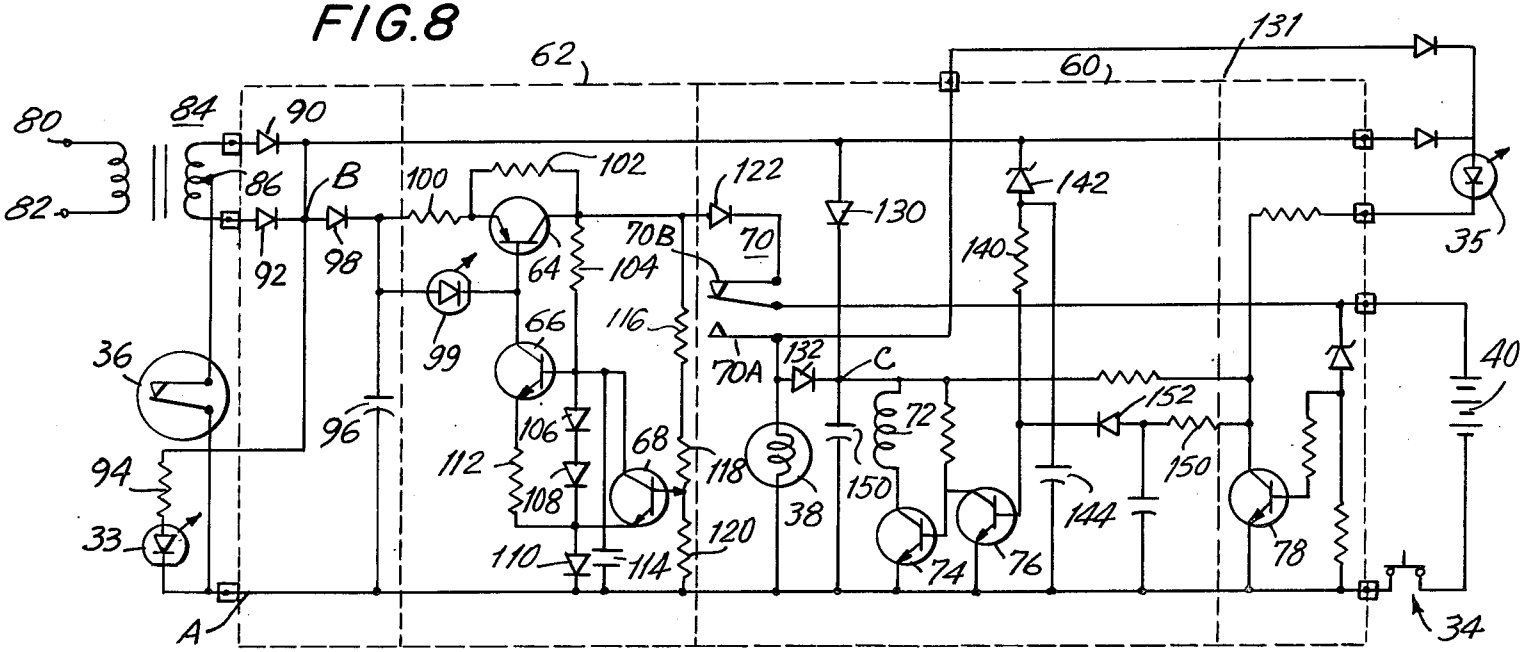
FIG. 8 is a schematic diagram of the electrical circuitry of the lighting system.

For convenience of the user (referring back to FIG. 1), once the base pate 12 has been secured by the mounting screws, AC power can be applied to the leads 16 at which point a yellow pilot light 33 should become lighted. At this point, if the yellow light does not light, the user can check the voltage connections between the available AC line and the AC leads 16 to the unit. Following this check, an ON-OFF switch 34 (FIG. 8) is activated. At this point a green indicator light 35 may or may not be lighted, the light serving to indicate that the battery and charger are operating properly. The unit is then tested insofar as the emergency lighting is concerned by placing the magnet 32 in near adjacency to test switch 36 (FIG. 8). When this is done, the bulb 38 (FIG. 1 and FIG. 8) will light, being then supplied with current from a battery supply 40 preferably comprising a number of individual batteries. If the green indicator light has not lighted, the unit cannot be tested. The cover 14 should then be replaced and the unit allowed to recharge for 24 hours before testing. Recharging of battery 40 is provided by means of a special charging circuit 62 seen in FIG. 8.

The cover is replaced by matching each of two bosses 41 inside the skirt at that particular side with a corresponding oblong hole 42 in the base plate 12. The cover is then swung into position and the tamper-proof screw 18 is tightened securely. At this point the magnet 32 is secured as described, that is, chain 30 is fastened under the screw 18 so that the magnet will be permanently attached.

The emergency lighting unit of the present invention is assembled such that the batteries 40 are encased or are mounted on a surface 43 of the base plate 12. This can be generally appreciated by reference to FIG. 4 in which the individual batteries are seen as held or retained by clips. All this makes for a very ready servicing of the batteries or replacement thereof, although this is extremely infrequently required. Mounted above the base plate is the reflector 13, comprising inclined sides 44 and platform 45. This mounting is accomplished by means of pillars or posts 46.

The printed circuit board 48 (which contains most of the components seen in the schematic diagram of FIG. 8) is connected or affixed in a flexible manner to the reflector platform 45 at the under side thereof (FIG. 5). This flexible mounting is accomplished by the use of four plastic connectors or devices 50 which extend through suitable holes in the reflector platform 45 but which can be readily withdrawn therefrom in case the printed circuit board must be replaced. As seen in FIG. 5, the magnetic test switch 36 is mounted on a separate PC board 49 which is disposed or situated adjacent the inclined side 44 of the reflector 13. Suitable openings are provided so that the light from the indicator lights 33 and 35 will be transmitted to the cover and thence to the ambient.

An additional hole 52 is provided in the reflector platform for the insertion of the lamp 38 which is received in a receptacle, not seen, in the PC board 48. The bulb 38 is a tungsten-halogen bulb which furnishes a highly concentrated light source. As previously noted, the reflector 13 is designed especially to work effectively with this highly concentrated light source; likewise, is the cover which, as aforenoted, serves as a diffuser means. As a result of the special design of these two components, that is, the broad reflector or platform and the wrap-around diffuser, in the form of cover 14, a non-glare light is provided over an extremely broad area.

The battery systems for the emergency lighting unit of the present invention include the totally sealed batteries 40 which are of nickel cadmium or lead calcium construction. Using either type of batteries, ample capacity is provided to support or furnish the lighting for well over one and one-half hours without going below 87½% of rated voltage, as required by the National Electrical Code. The battery system is protected against deep discharge by a low voltage dropout circuit, designated 60 in FIG. 8.

Referring now to FIG. 8, the charger or charger circuit 62 is a two-step constant current device and is implemented by means of solid state devices such as transistors 64, 66, 68. A covered, normally open relay 70 activates the emergency lighting when the AC power fails or is cut off. Thus, normally the relay coil 72 is not energized. This is because a transistor 74 which is available to supply current at its output to relay coil 72 is not normally conductive. Accordingly, contacts 70A are seen as normally open while contacts 70B associated with the same relay 70 are normally closed.

Power from a suitable AC source is conveyed to the circuit of FIG. 8 by way of the terminals designated 80 and 82 to a transformer 84, the secondary thereof being provided with a center tap connection 86 functioning as a ground return. The center tap is directly connected to magnetic test switch 36, the other side of the magnetic test switch being connected to common or ground line A. A common connection is provided at the cathode side of rectifying diodes 90 and 92, these devices serving to convert the AC supply to pulsating DC. It will be noted that this common cathode connection defines a hot line B, which is common for the entire circuitry. Also connected to the line B is the yellow indicator light 33 in the form of a light-emitting diode or the like and a current limiting resistor 94 for such device, the other side being taken to line A. Immediately to the right in FIG. 8 is a capacitor 96, which provides filtering of the resultant DC, and an isolation diode 98 connected between the DC side of the rectifying diodes and the capacitor so as to prevent leakage from the capacitor.

As aforenoted, the charging circuit 62 is essentially composed of a transistor 64, 66 and 68. Also provided is an optionally selected indicator lamp in the form of another L.E.D. 99. Further included in the charger circuit 62 is an emitter biasing resistor 100 for the transistor 64, the latter acting as a power transistor which is normally supplied with its own heat sink. A bypass resistor 102 is furnished to provide limited current when the transistor 64 is OFF. A resistor 104 is also furnished and is connected from the collector of transistor 64 to the base of transistor 66 in order to furnish base current for the latter device. Diodes 106 and 108 serve as clamps so as to clamp the base voltage of transistor 66 to a safe level; while diode 110 acts as a forward reference diode. Resistor 112 acts to furnish bias for transistor 66 which is a signal transistor. Capacitor 114 functions as a high frequency filtering device and effectively prevents undesired oscillations at high frequencies.

It will be understood that transistor 68 functions as a comparator device in order to prevent over-charging of the battery 40. For this purpose a voltage divider chain is provided in the form of three series connected resistors 116, 118 and 120. This arrangement permits sensing a portion of the battery voltage and comparing it with the reference voltage of the forward reference diode 110. Thus, when it is determined that the battery voltage has become excessive when compared with the reference voltage, transistor 68 will become turned on fully and this will result in turning off transistor 66 and, in consequence thereof, turning off transistor 64, with the result that charging current will no longer by supplied by way of relay contacts 70B to the battery 40.

The next sub-circuit is the aforementioned low voltage dropout circuit 60 which includes the components within the next box defined by the dotted lines, as seen in FIG. 8.

Charging current from the charger circuit 62 is applied to battery 40 by way of a diode 122 and the aforenoted normally closed relay contacts 70B, return therefrom being by way of the common ground or return line A, such line also being connected to an ON/OFF switch 34.

Under normal operating conditions, i.e., when the AC power supply is functioning the battery 40 is being charged by the charger circuit 62 and likewise under normal conditions AC power is being supplied by way of a diode 130 to a junction point denoted C. From this point output or collector voltage is available for the aforenoted transistor 74 and likewise for associated transistors 76 and 78, the latter being in what is referred to as a low battery voltage sensing sub-circuit 131. DC power is not furnished, due to the presence of diode 132, to the bulb or lamp 38 which furnishes the emergency illumination.

It will be understood that the relay coil 72 is normally not supplied with current from transistor 74 because that transistor is held OFF by reason of transistor 76 being held ON. The latter transistor is ON because of the base drive from the network which includes a resistor 140 and Zener diode 142, the junction point between these two elements being connected to a decoupling capacitor 144. Zener diode 142 and capacitor 144 provide reliable AC operation during low line condition (80–120 volt). This arrangement will also prevent emergency light activation during flickering power. When transistor 76 has turned OFF, that is, has become nonconductive, the bias at the base of transistor 74 becomes such as to forward bias that transistor and to turn it ON. When transistor 74 turns ON of course, current flows through the relay coil 72. The momentary or hold-on current is provided by power stored in capacitor 150 seen connected to junction point C. Once the relay coil 72 has become energized the contacts 70A will close with the result that a supply from battery 40 will now be available to hold the transistor 74 in the ON condition, and at the same time the battery 40 is able to supply the lamp or bulb 38 with current so that it provides the emergency illumination called for. It will be remembered that this emergency illumination from lamp 38 can be turned OFF by means of the ON/OFF switch 34 if it should become desirable.

The present invention also provides a low battery voltage sensor arrangement such that when the voltage from battery 40 drops to less than five volts, the lamp 38 is automatically disconnected from the battery so that the battery will not be run down or discharged completely. This is accomplished by reason of the fact that transistor 78 in the sensor circuit 131 is responsive at its base to such a condition; that is, the voltage at the base of transistor 78 will be so changed by a drop in the voltage of the battery 40 that the transistor 78 will turn OFF and in doing so, will provide leakage of current through resistor 150 and diode 152 in sufficient amount to provide base current to transistor 76 whereby this transistor will turn ON again and thereby turn OFF transistor 74, thereby to disconnect lamp 38 from battery 40 because of the consequent opening of relay contacts 70B.

What has been disclosed is a maintenance-free emergency lighting system that is completely self-contained due to the provision of a tough plastic cover which completely surrounds and protects the entire system from vandalism. Testing of the system is readily afforded by virtue of a magnetically operated test switch located within the housing, which switch can be normally closed but can be opened to test the system by means of a magnet suitably positioned adjacent the cover outside the housing. Further arrangements permit the emergency lamp to be floatingly mounted such as to preclude any shock to the dome-like cover from causing breakage of the lamp.

While there has been shown and described what is considered at present to be the preferred embodiment of the present invention, it will be appreciated by those skilled in the art that modifications of such embodiment may be made. It is therefore desired that the invention not be limited to this embodiment, and it is intended to cover in the appended claims all such modifications as fall within the true spirit and scope of the invention.

What is claimed is:

1. An emergency lighting device operable to connect a battery supply to an emergency lamp or the like in response to failure of the normal AC supply, comprising a. a base plate for mounting said device to a suitable surface;

b. means in the form of a dome-like, tough plastic, cover defining a housing for said device, said cover completely surrounding all components including said base plate, and said cover being free of any magnetic material adjacent the magnetically operated test switch recited hereinafter;

c. means for holding said cover in engagement with said base plate so as to secure said cover against tampering;

d. means within said housing for responding to a failure of AC power and for connecting the battery supply to the emergency lamp;

e. a reflector mounted to said base plate for reflecting light from said emergency lamp;

f. a magnetically operated test switch disposed immediately adjacent and inside said cover, said test switch being operable for simulating failure of AC power by disconnecting said power from the aforesaid means for responding, whereby the emergency lamp becomes illuminated in the event that said components are functioning properly;

g. means in the form of a removable magnet normally located remotely from the test switch for operating said switch.

2. A device as defined in claim 1, in which said means for holding said cover in engagement with said base plate comprises a screw extending through said cover and said base plate, said screw being non-removable but capable of being loosened.

3. A device as defined in claim 1, further including means for flexibly mounting said emergency lamp to prevent blows received by said housing from causing breakage of said lamp.

4. A device as defined in claim 3, in which said means for flexibly mounting includes plastic mounting devices, the one ends of which extend through apertures or holes provided in said platform, the other ends of said plastic mounting devices being secured in a printed circuit board on which said emergency lamp is connected.

5. A device as defined in claim 1, further comprising a relay having contacts which are normally open and also contacts which are normally closed, the normally closed contacts enabling connection of a charger circuit to said battery or battery supply, and said normally open contacts permitting connecting of said battery supply to said emergency lamp in response to failure of said AC supply.

6. A device as defined in claim 5, further comprising a supply transformer in which said magnetically operated test switch is connected to the midpoint of the secondary side of said transformer, operation of said test switch by said magnet being effective to energize the coil of said relay, thereby closing said normally open contacts thereof and causing illumination of said emergency lamp.

7. A device as defined in claim 5, further comprising means for sensing when the battery voltage has dropped to less than a predetermined voltage so as to disconnect the battery supply from said emergency lamp, thereby preventing extreme discharging of said battery supply.

* * * * *